US012209420B2

(12) United States Patent
Cipriani

(10) Patent No.: US 12,209,420 B2
(45) Date of Patent: Jan. 28, 2025

(54) LEVELER FOR TILES

(71) Applicant: DAKOTA GROUP S.A.S. DI ZENO CIPRIANI & C., Affi (IT)

(72) Inventor: Zeno Cipriani, Affi (IT)

(73) Assignee: DAKOTA GROUP S.A.S. DI ZENO CIPRIANI & C., Affi (IT)

( * ) Notice: Subject to any disclaimer, the term of this patent is extended or adjusted under 35 U.S.C. 154(b) by 270 days.

(21) Appl. No.: 17/922,323

(22) PCT Filed: Apr. 30, 2021

(86) PCT No.: PCT/IB2021/053609
§ 371 (c)(1),
(2) Date: Oct. 28, 2022

(87) PCT Pub. No.: WO2021/220232
PCT Pub. Date: Nov. 4, 2021

(65) Prior Publication Data

US 2023/0228105 A1 Jul. 20, 2023

(30) Foreign Application Priority Data

Apr. 30, 2020 (IT) ..... 102020000009568

(51) Int. Cl.
*E04F 21/22* (2006.01)

(52) U.S. Cl.
CPC ..... *E04F 21/22* (2013.01)

(58) Field of Classification Search
CPC . E04F 21/22; E04F 15/02022; E04F 21/1877; E04F 21/0092
See application file for complete search history.

(56) References Cited

U.S. PATENT DOCUMENTS

| | | | | |
|---|---|---|---|---|
| 2018/0148939 | A1* | 5/2018 | Sighinolfi | E04F 21/0092 |
| 2019/0127994 | A1* | 5/2019 | Cipriani | E04F 21/0092 |

FOREIGN PATENT DOCUMENTS

| | | |
|---|---|---|
| EP | 2 966 238 | 1/2016 |
| EP | 3 567 183 | 11/2019 |
| WO | 2016/189423 | 12/2016 |
| WO | 2017/195155 | 11/2017 |
| WO | 2020/026202 | 2/2020 |

OTHER PUBLICATIONS

International Search Report dated Aug. 30, 2021, for PCT/IB2021/053609, 4 pp.
Written Opinion dated Aug. 30, 2021, for PCT/IB2021/053609, 7 pp.

* cited by examiner

*Primary Examiner* — Patrick J Maestri
(74) *Attorney, Agent, or Firm* — NIXON & VANDERHYE

(57) ABSTRACT

Disclosed is a leveler that is able to bring two or more tiles it is in contact with to the same level.

20 Claims, 6 Drawing Sheets

LEVELER FOR TILES

This application is the U.S. national phase of International Application No. PCT/IB2021/053609 filed Apr. 30, 2021, which designated the U.S. and claims priority to IT 102020000009568 filed Apr. 30, 2020, the entire contents of each of which are hereby incorporated by reference.

The present invention relates generally to a leveler for tiles. In particular, it relates to a leveler that is capable of bringing two or more tiles with which it is placed in contact to the same level.

As is known, there are various types of tile levelers on the market that are suitable for bringing the top surface of a plurality of tiles to the same level.

One type of levelers involves the action of two elements, coupled together, specifically a support and a pressing body.

The support has a base and an elongated body that extends orthogonally from the base and has a thread.

The pressure body has a base in which there is a threaded hole homologous to the extended body.

The procedure for using levelers of this type is that the base is laid on the adhesive and two or more tiles are placed on it.

Then, the pressing body is coupled to the support, screwing the base on the extended body thanks to the threaded coupling.

By screwing on the base, the pressing body is brought down until the base is in contact with the tiles. By forcing the rotation, the base brings the upper surfaces of the tiles, and thus the tiles themselves, up to the same height on which it comes into contact.

Once the adhesive has dried and the tiles are fixed to the base support thanks to the adhesive, the elongated body and the pressure body fixed to it are removed by forcing the breakage of the support, i.e. separating the elongated body from the support base which remains permanently under the tiles.

This breakage is generally facilitated by the presence of a predefined breakage invitation in the joint between the base and the extended body.

Of course, once the extended body is separated from the base, it is no longer reusable, thus making the support a so-called disposable element.

The pressure body is instead recovered by unscrewing it from the extended body.

Levelers of this type present some problems, particularly in terms of ease, speed and comfort of use.

In particular, a first problem is related to the time needed to bring the pressing body to the tiles.

In fact, the pressing body must be screwed on the extended body for its whole length, even when the pressing body is not yet in contact with the tiles.

The operating times of this type of leveler are therefore considerable.

Another problem with the levelers according to the known technique and described above is the duration of the decoupling phase of the pressing body from the extended body, in order to be able to reuse the pressing body.

The purpose of the present invention is to realize a leveler that solves these and other problems of the known systems.

Another purpose of the invention is to obtain a leveler that can be used easily and quickly.

These and other purposes are all achieved, according to the invention, by a leveler suitable for use by a leveler suitable for being used by a user to lay and level at least two adjacent tiles on a floor.

The leveler comprises a support adapted to be constrained below the tiles and a pressing body. The pressing body is arranged above the tiles, adapted to be constrained movably to the support and to abut and press with an abutting surface on at least one of the at least two tiles.

The support comprises a base, adapted to be arranged below the at least two adjacent tiles, and a threaded pin developing orthogonally to the base and having a thread.

The pressing body comprises a gripping element and a release device received in a through opening formed in the gripping element.

The gripping element has a longitudinal central axis and an external lateral surface which the user can grip; the release device comprises a first element of cooperation and a second element of cooperation.

The first element of cooperation comprises a first thrust body and a first threaded portion; the second element of cooperation comprises a second thrust body and a second threaded portion.

The release device can be arranged according to a first configuration in which the first threaded portion and the second threaded portion face each other forming a single nut screw with homologous pitch to the thread of the threaded pin, and according to a second configuration in which by pushing on the first thrust body and the second thrust body, the first threaded portion and the second threaded portion are spaced apart.

In particular, the leveler according the invention is characterized by the fact that the first element of cooperation comprises a first elastic band and the second element of cooperation comprises a second elastic band, in which in the first configuration, the first elastic band abuts on the first thrust body and the second elastic band abuts on the second thrust body, and in the second configuration, the first elastic band is flexed and pushes on the second thrust body and the second elastic band is flexed and pushes on the first thrust body.

In this way, the user can conveniently screw the pressing body to the support, in order to press the same pressing body onto the tiles to be leveled.

On the other hand, in order to quickly insert or remove the threaded pin into/from the pressing body, it is sufficient to push on the pressing bodies, so that the two threaded portions move away from each other, avoiding the coupling with the threaded pin.

The second configuration is therefore useful when you want to bring the pressing body, in which the support has already been inserted, closer to the tiles or when you want to quickly free the pressing body from the threaded pin of the support.

Basically, by conveniently acting on the thrust bodies, the leveler according to the invention provides for a quick and easy coupling and uncoupling of the pressing body from the support, so that the same pressing body can translate without constraints with respect to the support or, by releasing the thrust bodies, can be screwed to carry out a regular and easy pressure on the tiles to be leveled.

Advantageously, the pressing body comprises a rubber annular body at the bottom so as to improve the grip on the tiles to be leveled.

Besides, the first element of cooperation may comprise a first tongue with a first tooth and the second element of cooperation may comprise a second tongue with a second tooth. The first tongue and the second tongue are adapted to rest on a plane inside the through opening, and the first tooth and the second tooth are adapted to be received in a seat formed in the plane so as to prevent the release device from coming out of the through opening.

Advantageously, the first thrust body and the second thrust body have a section having the same shape as the section of the through opening in which the release device is received, so that the first element of cooperation and the second element of cooperation can translate only inside the through opening.

Said shape coupling may be improved even thanks to the fact that the first element of cooperation and/or the second element of cooperation comprise a disc having the same section shape as the through opening.

Besides, the pressing body may comprise a cup element, in which the gripping element may comprise first coupling means and the cup element comprises second coupling means, so that through the first coupling means and the second coupling means the cup element can be coupled below the gripping element and can rotate with respect to the gripping element.

Advantageously, the rubber annular body may be coupled below the cup element.

Said coupling may be achieved because at least one through opening May be formed in the cup element and the annular body may comprise at least one protrusion with a V-crest, so that the protrusion can pass through the opening and the V-crest, placed beyond the opening, fixes the annular body to the cup element.

Besides, the cup element may comprise centrally a hollow truncated cone body in which a central hole is formed above through which the threaded pin can pass. Said hollow truncated cone body facilitates the insertion of the threaded pin into the pressing body.

Advantageously, at least one first opening may be formed in the gripping element and at least one slot may be formed in the cup element so that through the at least one first opening and the at least one slot it is possible to see below the cup element and the gripping element.

Further features and details may be better understood from the following description, given by way of non-limiting example, as well as from the accompanying drawing plates in which.

Figure 1:
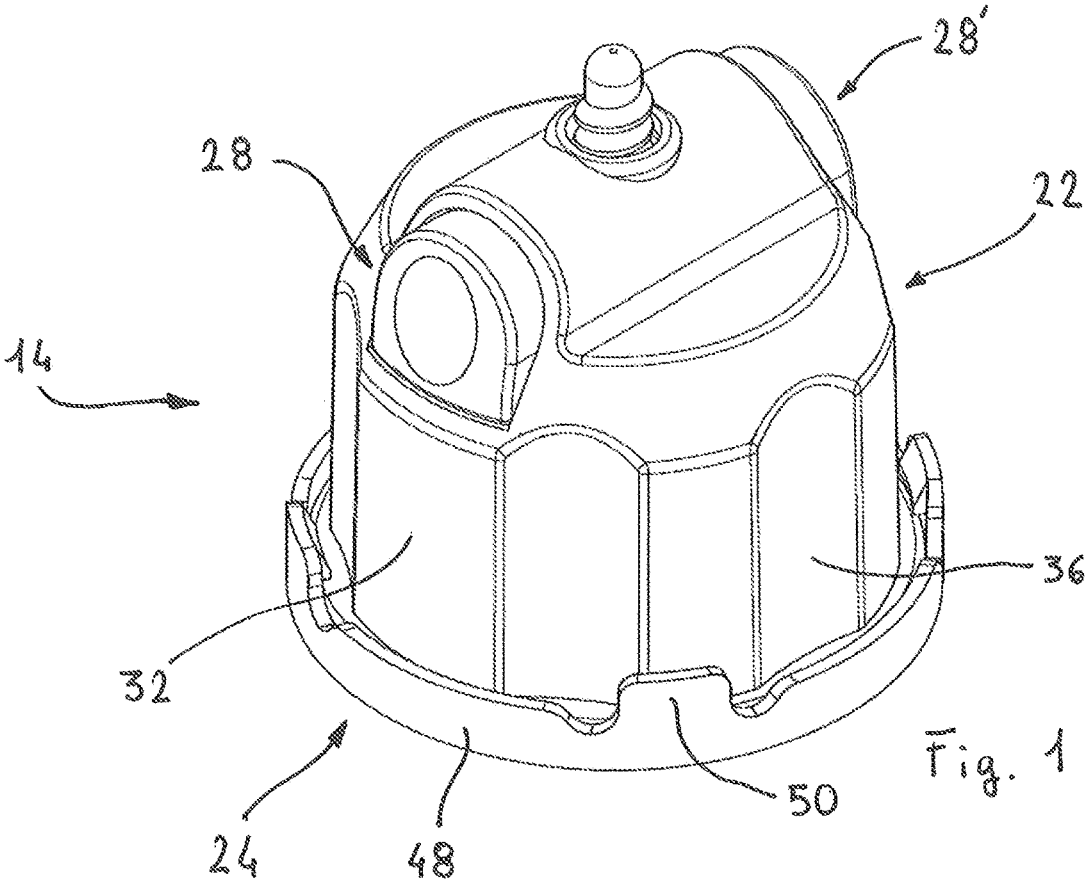
FIG. 1 is an axonometric view of a leveler, made according to the invention.
Figure 2:
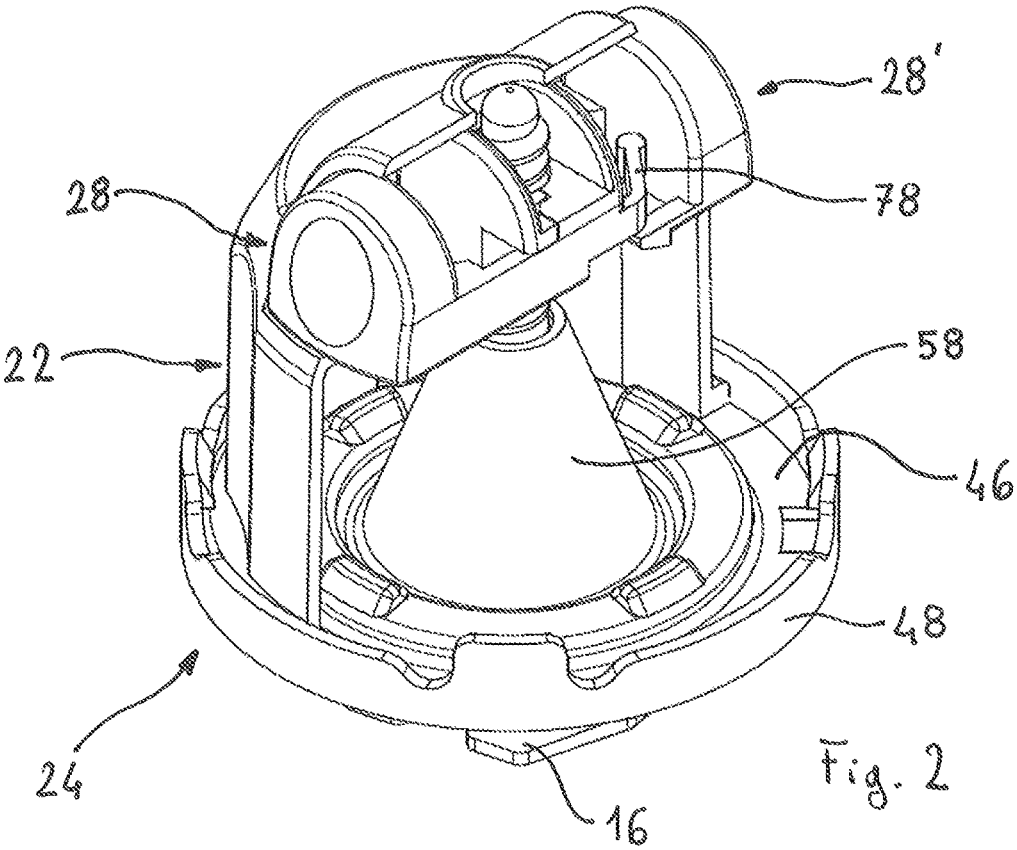
FIG. 2 is an axonometric view of the leveler of FIG. 1 deprived of a portion thereof to show its internal part.

With reference to FIGS. 1 to 7, 10 indicates a leveler, comprising a support 12 and a pressing body 14.

The support 12 comprises a base 16 from which a lamella 18 develops orthogonally; a threaded pin 20 protrudes from the end of the lamella 18.

Figure 3:
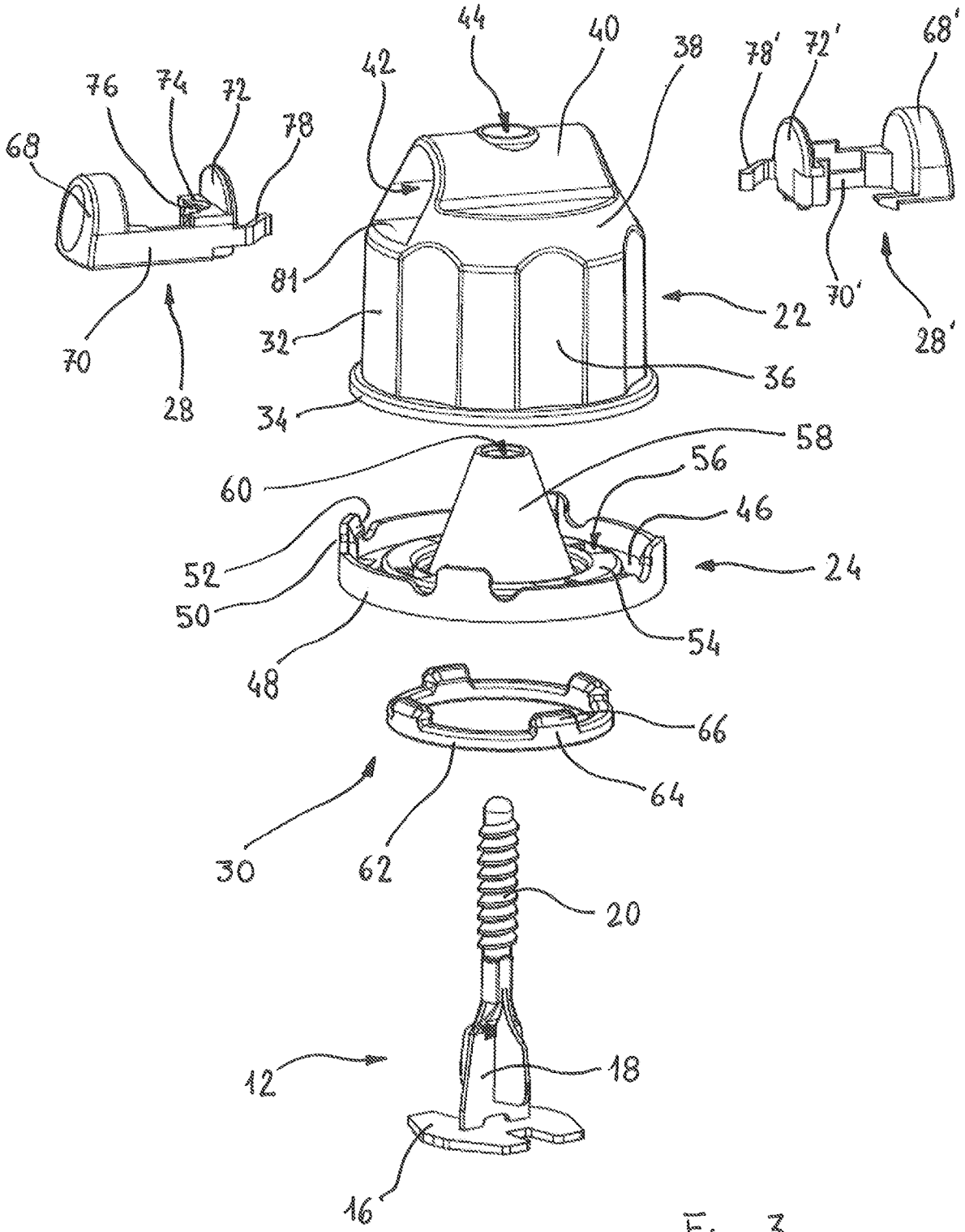
FIG. 3 is an exploded axonometric view of the leveler of FIG. 1.
Figure 4:
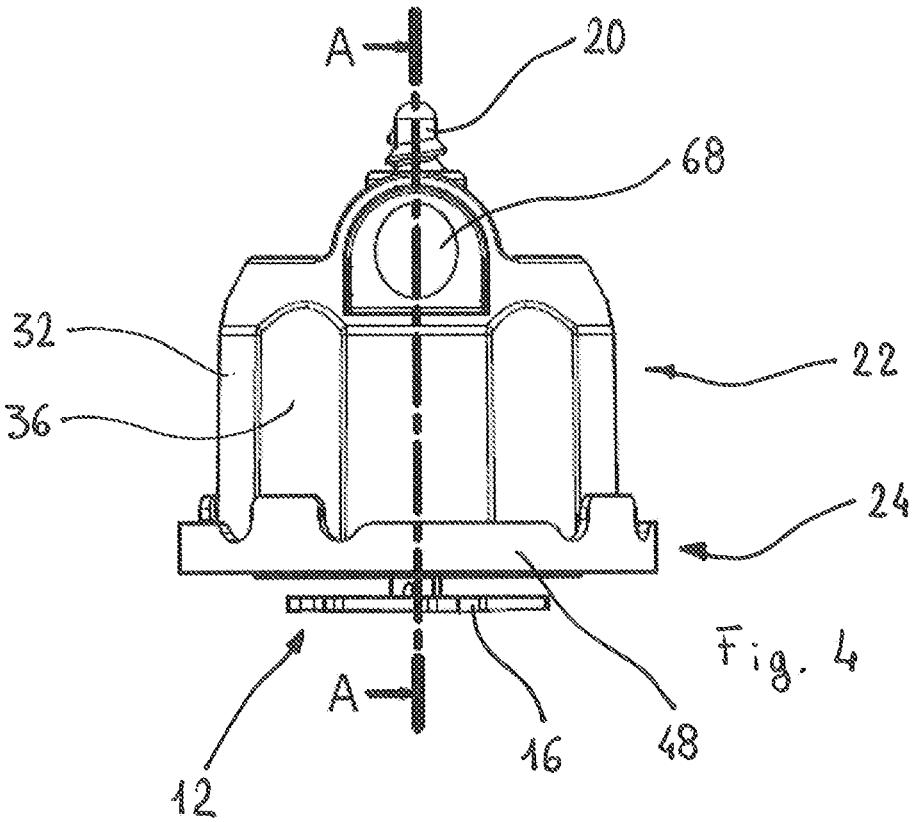
FIGS. 4 and 6 are side views of the leveler of FIG. 1.
Figure 5:
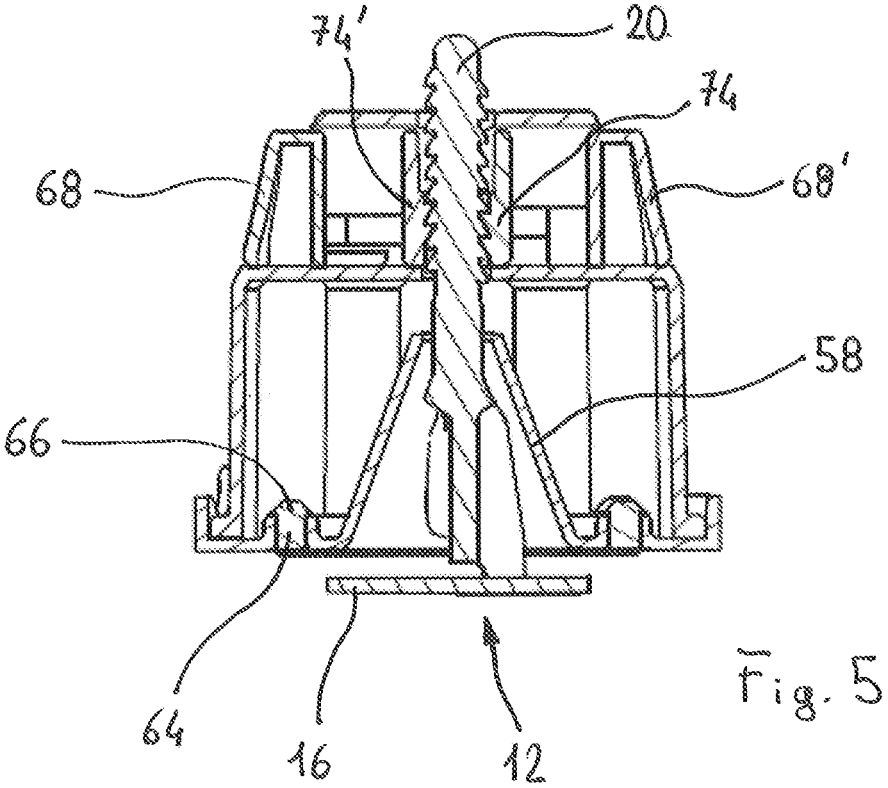
FIG. 5 is a sectional view of the FIG. 1 leveler according to the plane A-A indicated in FIG. 4.
Figure 6:
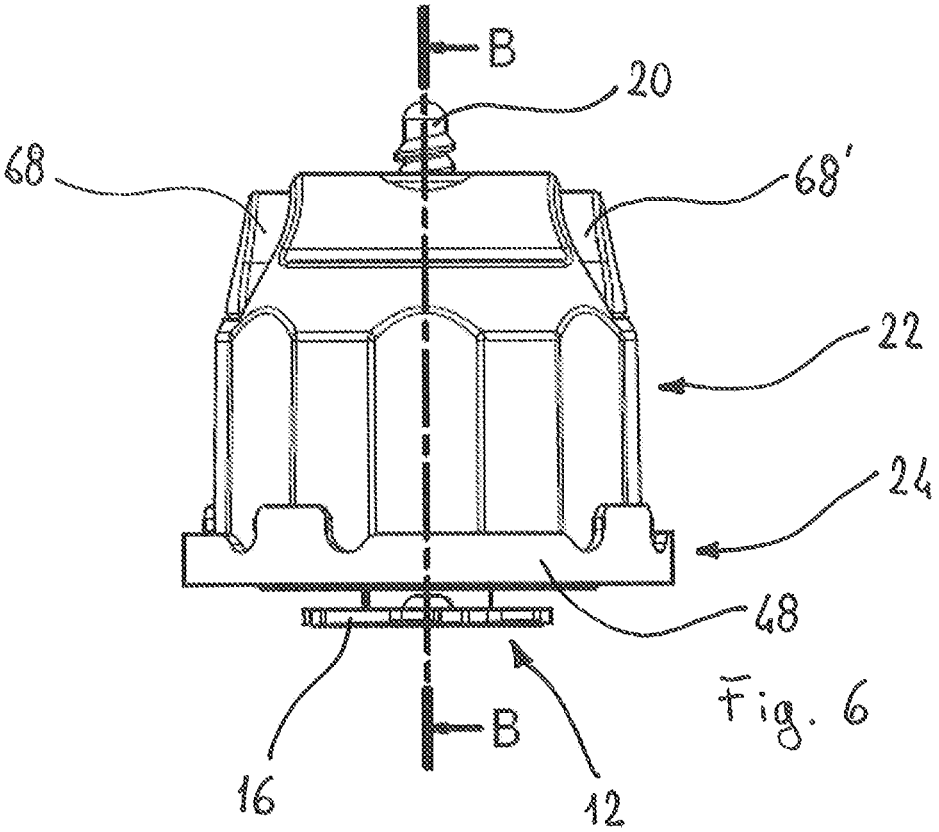
Figure 7:
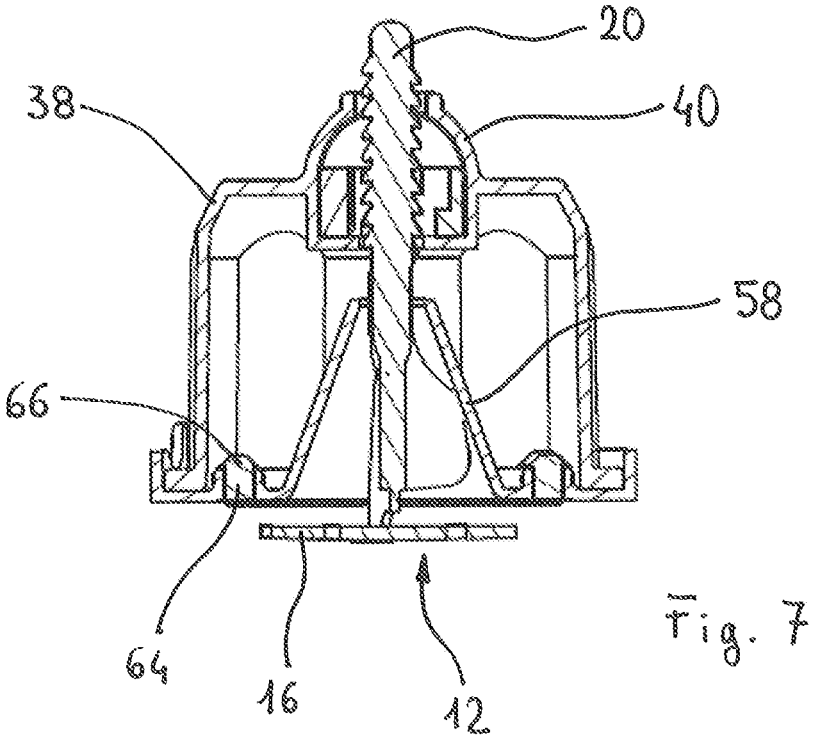
FIG. 7 is a sectional view of the leveler of FIG. 1 according to the plan B-B indicated in FIG. 6.

With particular reference to FIG. 3, the pressing body 14 comprises:

a gripping element 22, which is inferiorly open;

a cup element 24, able to close inferiorly the gripping element 22;

a release device 26, able to be inserted in an upper through opening of the gripping element 22 and formed by a first element of cooperation 28 and by a second element of cooperation 28';

an annular body 30, able to couple inferiorly with the cup element 24.

The gripping element 22 comprises a cylindrical portion 32 which is internally hollow, equipped with a protruding lower edge 34 and with slight cavities 36 obtained at angular intervals on the outer surface of said cylindrical portion 32.

A truncated cone portion 38 develops superiorly from the cylindrical portion 32; a semi-cylindrical portion 40 rises from the truncated cone portion 38 with development axis orthogonal to the development axis of the cylindrical portion 32.

A through opening 42 is obtained in the truncated cone portion 38 and in the semi-cylindrical portion 40; said through opening 42 is suitable for housing the release device 26 and having a development axis orthogonal to the development axis of the cylindrical portion 32.

A circular hole 44 is superiorly obtained in the semi-cylindrical portion 40; said circular hole 44 has axis coinciding with the axis of development of the cylindrical portion 32.

The cup element 24 comprises a base disk 46 from the circular perimeter of which protrudes a raised edge 48 provided with four protruding elements 50, arranged at 90° from each other and including each a slide tooth 52 (in FIG. 3 are indicated with respective numerical references only a protruding element and a slide tooth 52).

The base disk 46 comprises an annular profile 54 in which quattro through rectangular opening 56 are obtained.

Besides, from the base disk 46 there is a truncated cone body 58 in which there is a central hole 60 coaxial to the longitudinal development axis of the cup element 24.

The annular body 30 includes a ring 62 from which four projections 64 protrude above, arranged at 90° from each other and above provided with a V-crest 66 which expands beyond the width of the same projection from which it rises.

Moreover, the annular body 30 is made of rubber so as to increase the grip between the pressing body 14 and the tiles.

The release device 26 consists of the first element of cooperation 28 and the second element of cooperation 28', which are very similar to each other.

Each element of cooperation 28, 28', realized in a single body, includes a thrust body 68, 68' from which a bar 70, 70' protrudes together with a disc 72, 72'.

To the disc 72, 72' is internally attached, towards the thrust body 68, 68', an arched body 74, 74' on the surface of which is obtained a threaded portion 76, 76'.

An elastic band 78, 78' is, moreover, joined to the disc 72, 72', in a position opposite to the arched body 74, 74'.

On the other side with respect to the bar 70, 70' a tongue 80, 80' having at its end a slide tooth 82, 82' is attached.

A first element of cooperation 28 is coupled to a second element of cooperation 28', so that the elastic band 78 of the first element of cooperation 28 hits the rear of the thrust body 68' of the second element of cooperation 28'.

At the same time the arched body 74 of the first element of cooperation 28 faces the arched body 74 of the second element of cooperation 28.

The first element of cooperation 28 includes a protruding part 84 from the arched body 74 in a lateral position. And similarly, the second element of cooperation 28' includes a recess 86 obtained in the relative arched body 74'.

Figure 8:
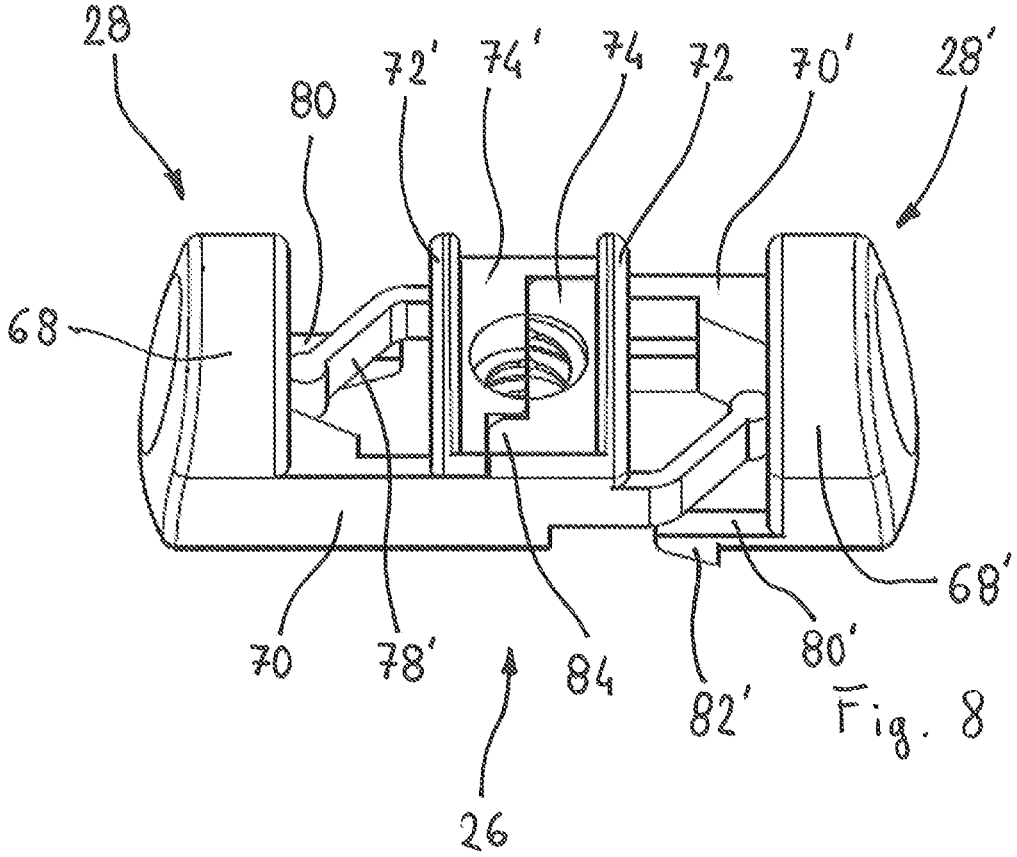
FIGS. 8 and 9 are axonometric views of an element of the leveler of FIG. 1 arranged respectively according to a first and a second configuration of use.

According to a first configuration, defined as screwing configuration, illustrated in FIG. 8, the elastic bands 78, 78' push the arched bodies 74, 74' to face each other, so that the threaded portions 76, 76' form together substantially a nut.

In such a configuration the protruding part 84 from the arched body 74 of the first element of cooperation 28 is received in the recess 86 of the arched body 74' of the second element of cooperation 28'.

Figure 9:
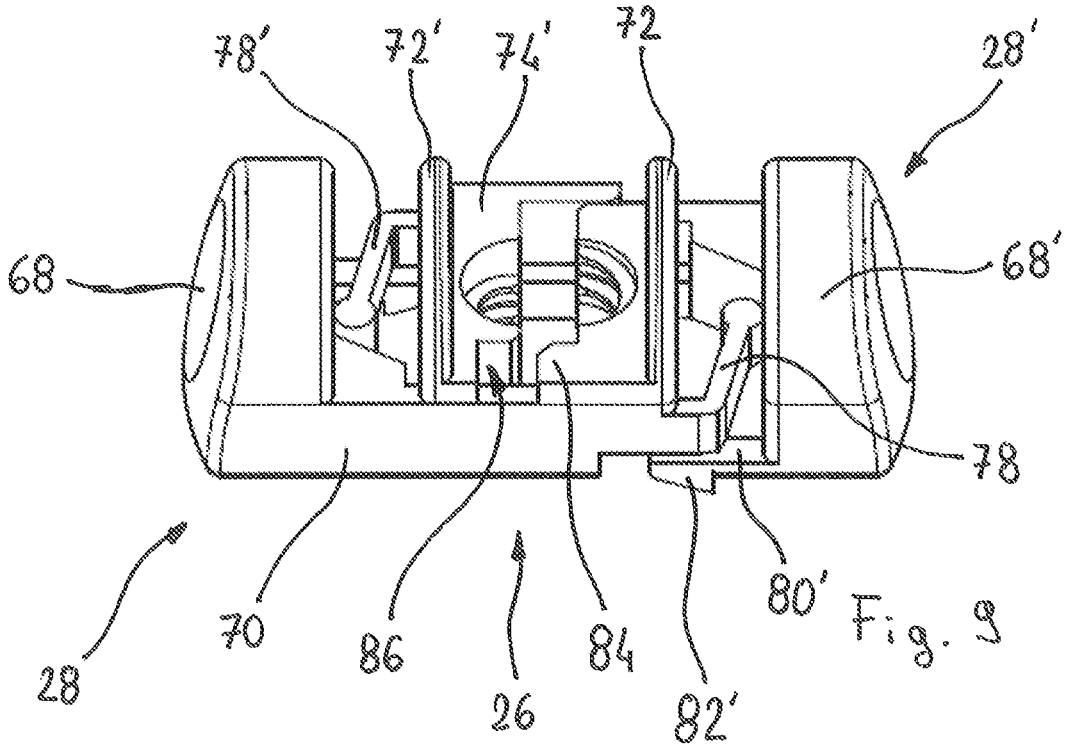
Figure 10:
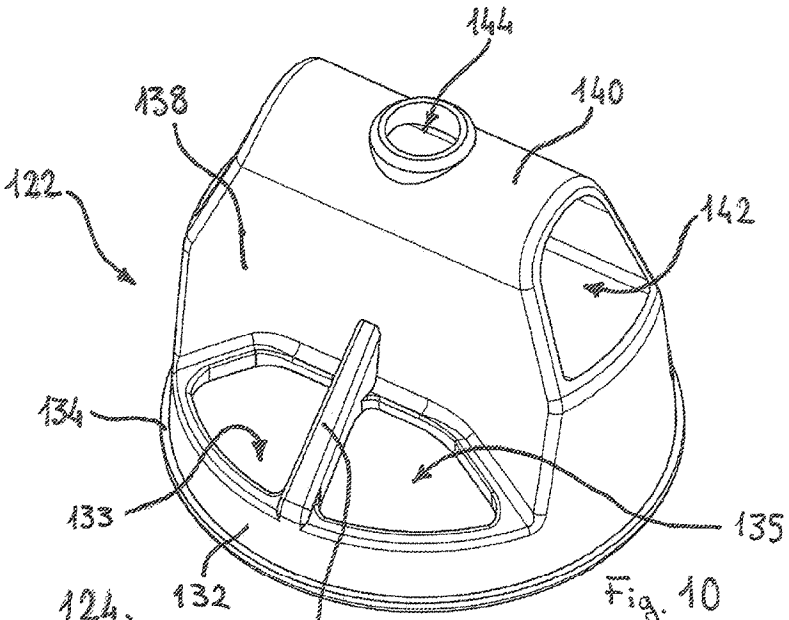
FIGS. 10 and 11 are axonometric views of two elements of the leveler according to a variant of the invention.

When the two thrust bodies 68, 68' are pushed and brought closer together, as in FIG. 9, the arched bodies 74, 74' recede. In this second configuration of the release device 28, referred to as the release configuration, there is no nut.

The following illustrates the procedure for using a leveler 10 according to the invention.

First, the pressing body 14 is to be mounted.

The gripping element 22 is coupled to the cup element 24: the former is pushed so that the lower edge 34 overcomes the slide teeth 52 of the four protruding elements.

In this way, the gripping element 22 is free to rotate relative to the cup element 24.

To the cup element 24 is fixed the annular body 30 by inserting the four projections 64 into the rectangular openings 56 through, so that the V-crests 66 pass over the same rectangular openings 56 by widening and keeping fixed the same annular body 30 to the cup element 24.

Finally, the first element of cooperation 28 and the second element of cooperation 28' are coupled, realizing the release device 26 which is inserted in the through opening 42.

The tongues 80, 80' rest on an internal plane 81 present in the opening 42, while the teeth 82, 82' are positioned in a seat obtained in the same internal plane 81, so as to prevent the release device 26 from escaping from the opening 42.

At the same time, however, pressure is allowed to be exerted on the two thrust bodies 68, 68' so as to arrange the same release device 26 in the screwing configuration or in the release configuration.

For the actual use of the leveler 10, i.e. the pressing body 14 and the support 12, one proceeds, at first, by placing a first tile in the desired position on top of the appropriate adhesive spread on the slab.

A user positions a support 12 in correspondence of the lateral edge of the same tile, edge to which a second tile is to be attached, so that the base 16 of the same support 12 is positioned between the same tile and the concrete slab.

The second tile is placed on the adhesive so as to be adjacent to the first tile and to be arranged above the base 16.

The slat 18 and the threaded pin 20 emerge from the gap between the two tiles. The distance between them is given by the thickness of slat 18, determining the width of the joint. The two tiles, in fact, are made to touch the slat 18, of chosen thickness.

Subsequently, the pressing body 14 is approached and coupled to the support 12, making sure that the threaded pin 20 of the same support 12 is inserted in the central hole 60 of the truncated cone body 58, which facilitates insertion.

At the same time, the user pushes the two push bodies 68, 68' of the release device 26 so as to arrange it in the release configuration.

The threaded pin 20 thus crosses the space between the two arched bodies 74, 74' without having to be screwed into the nut that would be formed if the release device 26 were in the screwed configuration.

In this way, a high time saving is achieved.

The threaded pin 20 also passes through the circular hole 44 of the semi-cylindrical portion 40, as long as the annular body 30 is not abutting the surface of at least one tile.

In this first configuration of the release device 26, the pressing body 14 is free to translate in height with respect to the support 12, without any particular constraints.

The user can thus easily and quickly bring the pressing body 14, by means of the annular body 30, into contact with the tiles, without having to screw the pressing body 14 to the support 12.

Subsequently, the user releases the release device 26 by placing it in the screwing configuration.

The thread 76 of the first element of cooperation 28 and the thread 76' of the second element of cooperation 28' thus form a single continuous thread that is coupled to the thread of the threaded pin 20.

In this second configuration of the release device 26, the leveler 10 is effectively used to level the tiles on which the annular body 30 is resting.

The user may, in fact, screw the pressing body 14 onto the support 12, specifically the gripping element 22 onto the threaded pin 20.

Once the pressing body 14 is in contact with one of the two tiles, the user rotates the pressing body 14, being able to grip it by means of the cavities 36.

In doing so, screwing the pressing body 14 onto the threaded pin 20 of the support 12 causes the annular body 30 to push down on the tile with the higher surface area.

The reduced thread pitch created by the two arched bodies 74, 74', in addition to improved adjustment, also allows for pressure to be applied to the tiles without the user having to make considerable effort to rotate the pressing body 14.

The user can terminate the screwing when the annular body 30 is abutting both tiles.

When the two tiles have their edges at the same height, and when this operation has been carried out for all the levelers placed on the tiled surface being made, the adhesive is allowed to dry, so that the tiles are firmly fixed to the floor.

Subsequently, the user removes the pressing body 14 and part of the support 12, acting with a kick or with a violent blow on the same pressing body 14.

In fact, the impact on the pressing body 14 causes the detachment of the slat 18 and of the threaded pin 20, secured to the pressing body 14, from the base 16 that remains under the tiles.

This is possible thanks to the reduced thickness of the connection portion of the plate 18 to the base 16.

Subsequently, the various pressing bodies 14 used for laying the tiles may be recovered for their new use by separating the threaded pin 20 from the pressing body 14.

To perform this operation at speed, alternatively to unscrewing the threaded pin 20 from the pressing body 14, it is sufficient to push the two push bodies 68, 68' of the release device, to make the two arched bodies 74, 74' move away from each other and easily free the threaded pin 20.

According to a variation of the invention, a leveler not shown as a whole comprises:

- a gripping element 122, inferiorly open;
- a cup element 124, capable of inferiorly closing the gripping element 122;
- a release device 26, as previously described and suitable for inserting into an upper through opening of the gripping element 122;
- an annular body 30, as previously described and capable of coupling inferiorly to the cup element 124.

The gripping element 122 includes a cylindrical portion 132 internally hollow, provided with a protruding lower edge 134.

From the cylindrical portion 132, an elongated portion 138 develops above, from which a semi-cylindrical portion 140 rises in turn, having a development axis orthogonal to the development axis of the cylindrical portion 132.

On both sides of the gripping element 122, between the cylindrical portion 132 and the elongated portion 138 are obtained a first opening 133 and a second opening 135 between them divided by a rib 137.

In the elongated portion 138 and in the semi-cylindrical portion 140 there is a through opening 142 suitable to accommodate the release device 26 and having a development axis orthogonal to the development axis of the cylindrical portion 132.

In the semi-cylindrical portion 140, a circular hole 144 having an axis coinciding with the development axis of the cylindrical portion 132 is obtained above.

Figure 11:
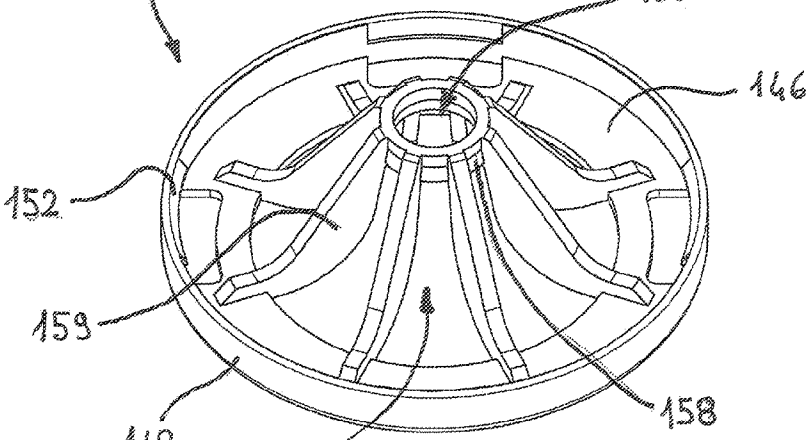
Figure 12:
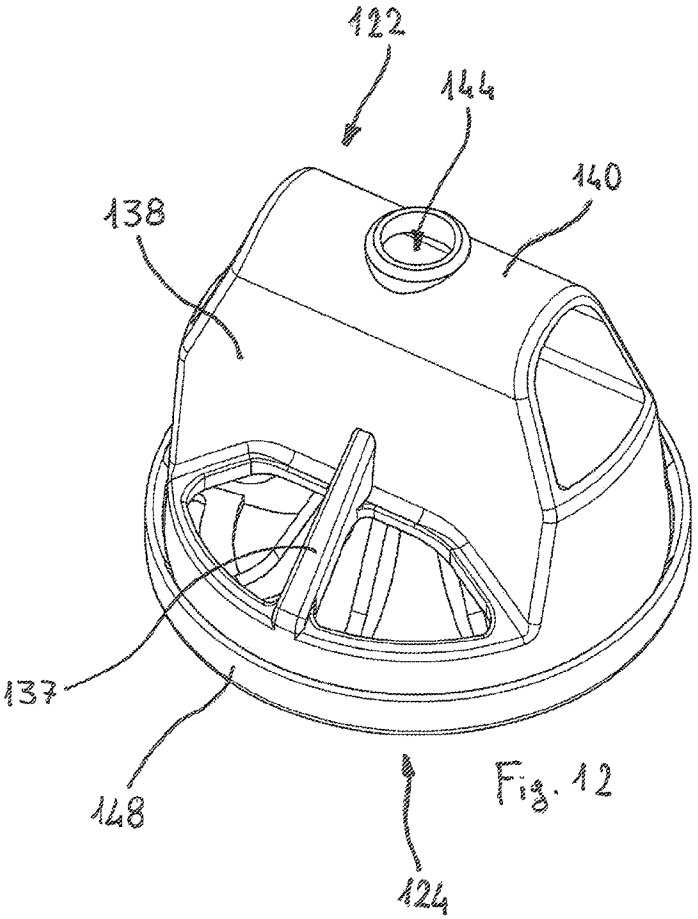
FIG. 12 is an axonometric view of the two elements of FIGS. 10 and 11 connected together.

The cup element 124 includes a base disk 146 from whose circular perimeter protrudes a raised edge 148 provided with four slide teeth 152, placed at 90° from each other (in FIG. 11 only a slide tooth 152 is indicated with respective numerical references).

From the base disk 146 the ribs 159 (only one of them is indicated with the numerical reference in FIG. 11) rise centrally and upwards and join a central neck 158 in which a central hole 160 is located, coaxial to the longitudinal development axis of the cup element 124.

Between the ribs 159, in the space between the base disk 146 and the central neck 158, slots 157 are thus created which allow to see inferiorly to the cup element 124.

The gripping element 122 is received into the cup element 124; in particular, the cylindrical portion 132 is inserted into the raised edge 148 until the protruding lower edge 134 has gone below the four slide teeth 152 which act as a block of the gripping element 122 in the vertical direction, but still allow it to rotate with respect to the cup element 124 itself.

The gripping element 122 and the cup element 124 are used and have the same function as the gripping element 22 and the cup element 24 previously described.

Moreover, the first opening 133 and the second opening 135 in the gripping element 122 together with the slots 157 allow the user to see below, in particular they allow to verify the alignment of the joints in case the leveler is positioned at the intersection of 4 tiles.

There may also be variants to be considered within the scope of the invention defined by the following claims. For example, the leveler according to the invention may comprise coupling means between the support and the presser body other than threading, such as to form coupling.

The invention claimed is:

1. Leveler suitable for being used by a user to lay and level at least two adjacent tiles on a floor, said leveler comprising a support adapted to be constrained below the tiles and a pressing body arranged above the tiles and adapted to be constrained movably to the support and to abut and press with an abutting surface on at least one of the at least two tiles; said support comprising a base, adapted to be arranged below the at least two adjacent tiles, and a threaded pin developing orthogonally to the base and having a thread; the pressing body comprising a gripping element and a release device received in a through opening formed in the gripping element; the gripping element having a longitudinal central axis and an external lateral surface which the user can grip; the release device comprising a first element of cooperation and a second element of cooperation; the first element of cooperation comprising a first thrust body and a first threaded portion; the second element of cooperation comprising a second thrust body and a second threaded portion; the release device being arranged according to a first configuration in which the first threaded portion and the second threaded portion face each other forming a single nut screw with homologous pitch to the thread of the threaded pin, and according to a second configuration in which by pushing on the first thrust body and the second thrust body, the first threaded portion and the second threaded portion are spaced apart;

wherein the first element of cooperation comprises a first elastic band and the second element of cooperation comprises a second elastic band, in which in the first configuration, the first elastic band abuts on the first thrust body and the second elastic band abuts on the second thrust body, and in the second configuration, the first elastic band is flexed and pushes on the second thrust body and the second elastic band is flexed and pushes on the first thrust body.

2. The leveler of claim 1, wherein the pressing body comprises a rubber annular body.

3. The leveler of claim 1, wherein the first element of cooperation comprises a first tongue with a first tooth and the second element of cooperation comprises a second tongue with a second tooth; the first tongue and the second tongue being adapted to rest on a plane inside the through opening, the first tooth and the second tooth being adapted to be received in a seat formed in the plane so as to prevent the release device from coming out of the through opening.

4. The leveler of claim 1, wherein the first thrust body and the second thrust body have a section having the same shape as the section of the through opening in which the release device is received, so that the first element of cooperation and the second element of cooperation can translate only inside the through opening.

5. The leveler of claim 1, wherein the first element of cooperation and/or the second element of cooperation comprise a disc having the same section shape as the through opening.

6. The leveler of claim 1, wherein the pressing body comprises a cup element, in which the gripping element comprises first coupling means and the cup element comprises second coupling means, so that through the first coupling means and the second coupling means the cup element can be coupled below the gripping element and can rotate with respect to the gripping element.

7. The leveler of claim 6, wherein a rubber annular body is coupled below the cup element.

8. The leveler of claim 7, wherein at least one through opening is formed in the cup element and the annular body comprises at least one protrusion with a V-crest, so that the protrusion can pass through the opening and the V-crest, placed beyond the opening, fixes the annular body to the cup element.

9. The leveler of claim 6, wherein the cup element comprises centrally a hollow truncated cone body in which a central hole is formed above through which the threaded pin can pass.

10. The leveler of claim 6, wherein at least one first opening is formed in the gripping element and at least one slot is formed in the cup element so that through the at least one first opening and the at least one slot it is possible to see below the cup element and the gripping element.

11. The leveler of claim 2, wherein the first element of cooperation comprises a first tongue with a first tooth and the second element of cooperation comprises a second tongue with a second tooth; the first tongue and the second tongue being adapted to rest on a plane inside the through opening, the first tooth and the second tooth being adapted to be received in a seat formed in the plane so as to prevent the release device from coming out of the through opening.

12. The leveler of claim 2, wherein the first thrust body and the second thrust body have a section having the same shape as the section of the through opening in which the release device is received, so that the first element of cooperation and the second element of cooperation can translate only inside the through opening.

13. The leveler of claim 3, wherein the first thrust body and the second thrust body have a section having the same shape as the section of the through opening in which the release device is received, so that the first element of cooperation and the second element of cooperation can translate only inside the through opening.

14. The leveler of claim 2, wherein the first element of cooperation and/or the second element of cooperation comprise a disc having the same section shape as the through opening.

15. The leveler of claim 3, wherein the first element of cooperation and/or the second element of cooperation comprise a disc having the same section shape as the through opening.

16. The leveler of claim 4, wherein the first element of cooperation and/or the second element of cooperation comprise a disc having the same section shape as the through opening.

17. The leveler of claim 2, wherein the pressing body comprises a cup element, in which the gripping element comprises first coupling means and the cup element comprises second coupling means, so that through the first coupling means and the second coupling means the cup element can be coupled below the gripping element and can rotate with respect to the gripping element.

18. The leveler of claim 3, wherein the pressing body comprises a cup element, in which the gripping element comprises first coupling means and the cup element comprises second coupling means, so that through the first coupling means and the second coupling means the cup element can be coupled below the gripping element and can rotate with respect to the gripping element.

19. The leveler of claim 4, wherein the pressing body comprises a cup element, in which the gripping element comprises first coupling means and the cup element comprises second coupling means, so that through the first coupling means and the second coupling means the cup element can be coupled below the gripping element and can rotate with respect to the gripping element.

20. The leveler of claim 5, wherein the pressing body comprises a cup element, in which the gripping element comprises first coupling means and the cup element comprises second coupling means, so that through the first coupling means and the second coupling means the cup element can be coupled below the gripping element and can rotate with respect to the gripping element.

* * * * *